US008992072B2

(12) United States Patent
Dorsch

(10) Patent No.: US 8,992,072 B2
(45) Date of Patent: Mar. 31, 2015

(54) NOZZLE SYSTEM FOR TANK FLOOR

(75) Inventor: Glenn R. Dorsch, Aberdeen, WA (US)

(73) Assignee: Vaughan Company, Inc., Montesano, WA (US)

( * ) Notice: Subject to any disclaimer, the term of this patent is extended or adjusted under 35 U.S.C. 154(b) by 1116 days.

(21) Appl. No.: 13/004,556

(22) Filed: Jan. 11, 2011

(65) Prior Publication Data

US 2011/0180152 A1 Jul. 28, 2011

Related U.S. Application Data

(63) Continuation-in-part of application No. 12/694,396, filed on Jan. 27, 2010.

(51) Int. Cl.

| | |
|---|---|
| ***B01F 5/02*** | (2006.01) |
| ***B08B 9/093*** | (2006.01) |
| ***B01F 5/10*** | (2006.01) |

(52) U.S. Cl.

CPC ..... *B08B 9/0933* (2013.01); *B01F 5/0206* (2013.01); *B01F 5/10* (2013.01)

USPC ..... 366/173.2; 366/175.2

(58) Field of Classification Search

CPC ..... B01F 5/205

USPC ..... 366/173.1, 173, 2, 175.2, 137.1, 173.2

See application file for complete search history.

(56) References Cited

U.S. PATENT DOCUMENTS

| | | | | |
|---|---|---|---|---|
| 626,950 | A | 6/1899 | Wheelwright | |
| 1,043,644 | A | 11/1912 | Thomas | |
| 2,628,204 | A * | 2/1953 | Gray | 523/315 |
| 4,846,582 | A * | 7/1989 | Davidsson | 366/137.1 |
| 7,025,492 | B2 | 4/2006 | Dorsch et al. | |
| 7,628,183 | B2 | 12/2009 | Dorsch et al. | |

* cited by examiner

*Primary Examiner* — David Sorkin

(74) *Attorney, Agent, or Firm* — Bishop Diehl & Lee, Ltd.

(57) ABSTRACT

A nozzle system for mixing contents in a tank and scouring surfaces of debris and sediment is disclosed. The system is capable of use either below or above a tank's liquid content surface as well as being adaptable to flow channels and other surfaces which may become impeded with sediment and debris. The nozzle system includes at least one nozzle receiving fluid from a pump, and a splash plate positioned to deflect a discharged stream from the nozzle in a spread and downward direction. The number and positioning of additional nozzles in the system can be determined by mapping the discharge of each splash plate equipped nozzle and arranging for the desired area of coverage.

24 Claims, 8 Drawing Sheets

NOZZLE SYSTEM FOR TANK FLOOR

RELATED APPLICATION

This application is a continuation-in-part and claims the filing priority of co-pending U.S. patent application Ser. No. 12/694,396, filed Jan. 27, 2010, titled "System Having Foam Busting Nozzle and Sub-surface Mixing Nozzle" (the '396 application), the contents also of which are hereby incorporated by reference. The '396 application is assigned to the assignee of the present application.

TECHNICAL FIELD OF THE INVENTION

The present device relates to a system of nozzles for use on wastewater storage tanks and the like. Particularly, the present device relates to a nozzle system for moving sediment on a tank floor.

BACKGROUND OF THE INVENTION

Storm water runoff can pose significant issues for sewage water treatment facilities. Often such facilities have a CSO (Combined Sewage Overflow) system. A CSO system is comprised of a big tank, like a huge swimming pool, that collects the storm water runoff so that the runoff does not just get dumped into the local waterways. Typically, local sewage treatment plants cannot handle the added flow from a rain storm, so they bypass the water treatment and dump thousands of gallons of untreated water into local waterways. As an alternative, the CSO system collects this rain and sewage and gradually pumps it to the treatment plant for processing. This approach keeps sewage out of the local rivers and lakes.

Along with pollutants and toxins, the runoff water can carry with it a great deal of debris and unsettled sediment carried from roadways, parking lots, and the like. To the extent that such sediment remains entrained in the water flow, it can be properly filtered at the treatment facility. Likewise, the pollutants and toxins can be removed with proper treatment at the facility. However, where the runoff water is held for long periods of time, the debris and sediment can settle out of the water and deposit on the CSO tank bottom where it may fill the sump and block the pump which sends the water out to the treatment plant.

Even if the sediment and debris does not immediately block pumping action, the buildup will continue to reduce the volume of the CSO tank. For all the reasons described above, a loss of overflow volume could lead to contamination of local waterways, such as ponds, lakes, streams and the like.

Another problem with prior systems has to do with nozzle pressure and clogging. Typical pumps and nozzles for such operations are sized to provide about 10 psi of head pressure at each nozzle, with a nozzle discharge velocity in the range of from about 30 to about 40 feet/second. Systems having six nozzles have been successfully used to entrain debris and wash away deposits of silt, sand and grit (i.e., small particle size sediment). However, to maintain the desired pump and system pressure and nozzle discharge velocity, nozzle openings must be a specific size.

For example, in one known application the nozzle openings have an diameter of no more than 2.5 inches (about 6.4 cm). When larger debris, such as shoes, balls, branches, etc., enter the CSO tank, it can quickly clog the 2.5 inch nozzles. Accordingly, nozzles having larger opening diameters must be used to prevent clogging, but using the same pump (designed for a particular optimum flow with the smaller 2.5 inch nozzles) requires the use of fewer nozzles to prevent a drop in head pressure and discharge velocity.

It is well-known that nozzle flow is related to discharge velocity by the equation:

$$V=0.408Q/d^2$$

where, V is velocity (ft/sec), Q is flow (U.S. gal/min) and d is nozzle opening diameter (inches). The following chart illustrates the potential drop in velocity by switching from 2.5 inch nozzles to 3.5 inch nozzles with maintained flow.

TABLE 1

| Velocity drop | | |
|---|---|---|
| | Flow (Q) | Velocity (V) |
| 2.5 inch Nozzle | 580 gpm | 38 ft/sec |
| 3.5 inch Nozzle | 580 gpm | 19 ft/sec |

Using six larger 3.5 inch nozzles also precipitously drops system discharge pressure, allowing the centrifugal pump to create too much flow, which leads to the creation of damaging cavitation inside the pump. As a means to maintain velocity in the 30 to 40 ft/sec range without increasing the pump power and to avoid pump damage from high-flow cavitation, fewer flow nozzles must be used—about half the number of nozzles based on the velocity drop. Unfortunately, the use of fewer nozzles in large CSO tanks presents an issue in that the resulting system will be unable to properly stir the tank contents while also simultaneously washing away settled debris at the tank center.

As illustrated in FIG. 1, a typical three nozzle tank mixing system creates high mixing velocities along the outermost zone of the tank. However, a low-velocity region exists at the tank center which allows the settling of sand, grit and debris. Over time, a large deposit of such material will exist in this low-velocity area. One way those skilled in the art may eliminate the sediment and debris is to physically enter the CSO tank and move the deposits with tools and/or large quantities of pressurized water. This can only be done, of course, when the CSO tank is substantially empty and not in use.

The present system, device and methods solve the numerous problems of mixing, discharging settled debris from tanks, surfaces, and the like, and preventing clogging of the nozzles. The present system, device and methods are capable of not only preventing settling of sediment and debris, but may be implemented in tanks already impinged with sediment to remove such from a tank bottom or other surfaces. The present system accomplishes these and other goals without sacrificing coverage area, head pressure, or discharge velocity.

SUMMARY OF THE INVENTION

There is disclosed herein an improved tank mixing system and mixing nozzle which avoids the disadvantages of prior devices while affording additional structural and operating advantages. The systems, devices and methods disclosed operate to prevent sediment buildup on a surface, such as a waste-water tank bottom, remove such buildup after it occurs, or both.

In one embodiment, a system for moving solids accumulated on a surface is disclosed. Generally, the system comprises a plurality of liquid dispensing nozzles positioned above the surface, at least one splash plate above the nozzle discharge, a liquid source, and a pump for circulating the liquid through the nozzle where it is deflected and spread when it contacts the splash plate. In this embodiment, each of the nozzles has an inlet for receiving pressurized liquid and an outlet for ejecting a liquid stream along a path. The splash plate is preferably positioned superiorly adjacent to the outlet of at least one nozzle in the path of the liquid stream and at an angle of inclination relative to the path. The splash plate deflects the liquid stream toward the accumulated solids on the surface.

In another embodiment, a system for removing sediment deposited on a surface comprises a supply of liquid, a liquid dispensing nozzle positioned above the surface, a splash plate, and a fluid pump coupling the nozzle and the supply of liquid. The nozzle includes an inlet for receiving pressurized liquid and an outlet for ejecting a liquid stream along a path, while the splash plate is positioned superiorly adjacent to the nozzle outlet in the path of the liquid stream at an angle of inclination relative to the path. This operates to pump material from the supply through the nozzle outlet.

In another embodiment, a wastewater storage tank system is specifically disclosed. The system comprises a tank, as well as a nozzle, a splash plate, and a pump, as in previous embodiments. The tank is an enclosed volume fed by an inlet for delivering wastewater into the tank and an outlet for discharging wastewater there from. The nozzle is preferably positioned within the tank and includes an inlet for receiving pressurized liquid and an outlet for ejecting a liquid stream along a path. The splash plate is again positioned superiorly adjacent to the nozzle outlet in the path of the liquid stream at an angle of inclination relative to the path. The pump includes an inlet fluidly connected to the tank and operates to pump material from the tank through the nozzle outlet.

In all the described system embodiments, it is an aspect of each to have an angle of inclination in the range of from about 5 degrees to about 30 degrees, preferably in the range of from about 10 degrees to about 20 degrees. The most preferred angle of inclination of the splash plate is about 15 degrees, relative to the stream of liquid. It may be an aspect of the embodiments wherein the nozzle outlet itself is also angled to direct the path of the liquid stream toward the surface, such as a tank or channel bottom.

Also disclosed is a method for removing sediment deposited onto a surface using tank mixing nozzles. An embodiment of the disclosed method comprises the steps of aiming a liquid dispensing nozzle at an area of a surface having deposited sediment, pumping liquid at a sufficient pressure from a liquid source to an outlet of the nozzle, discharging the liquid from the nozzle in a concentrated stream along a path directed substantially at the deposited sediment, and deflecting the liquid stream downward to spread the stream outward in a direction substantially perpendicular to the concentrated stream. Preferably, the step of deflecting the liquid stream comprises the step of securing a splash plate in the path of the concentrated stream. The splash plate is preferably secured at an angle relative to the path of concentrated stream.

In another embodiment of a method, steps for preventing the deposit of sediment onto a surface using tank mixing nozzles is disclosed. The preventative method comprises the steps of aiming a liquid dispensing nozzle at an area of a surface prone to deposition of sediment, pumping liquid at a sufficient pressure from a liquid source to an outlet of the nozzle, discharging the liquid from the nozzle in a concentrated stream along a path directed toward the area of the surface subject to deposition of sediment, and deflecting the liquid stream downward to spread the stream outward in a direction substantially perpendicular to the concentrated stream.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
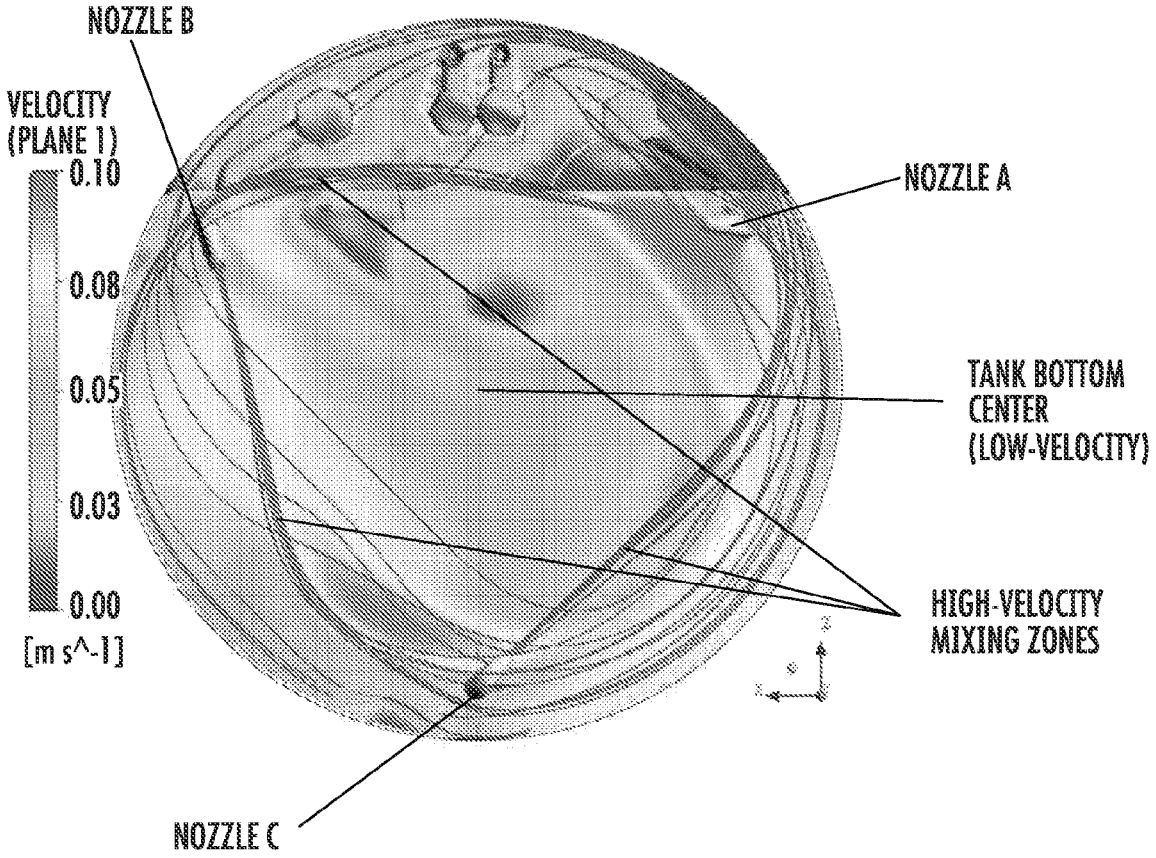
FIG. 1 (PRIOR ART)
FIG. 1 is a computational fluid dynamic (CFD) image of a prior art tank system.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 2-10, there are illustrated various aspects of a tank mixing and surface scouring system, including methods, generally designated by the numeral 10. While the disclosed embodiments are shown primarily in conjunction with a storage tank, alterations may be made to adapt the system 10 to, for example, mixing tanks of any kind and for most any purpose where solid deposits may cause a problem.

Generally speaking, a preferred system 10 has a cylindrical tank 20 having a floor sloped toward a sump 22, a plurality of liquid dispensing nozzles 12, a splash plate 14 attached to at least some of the nozzles, and a pump 16 for circulating a supply of liquid, preferably the liquid or liquid slurry which exists within the tank 20. In a preferred method, the liquid is pumped from the tank 20 and through the plurality of nozzles 12, where the resulting stream is deflected by the splash plates 14 to spread outward in a direction perpendicular to the initial stream. The stream is also deflected downward toward the tank floor. The resulting mixing action is exemplified in the CFD image of FIG. 2. In contrast to the prior art system of FIG. 1, the lack of a low-velocity zone in the tank center of FIG. 2 helps prevents entrained sediment from settling out and collecting on the tank bottom.

In one configuration, the disclosed system 10 is intended for use in what is known as a "Combined Sewer Overflow" (CSO) system which collects rain and sewer water during storms for holding until such material can be pumped into the sewage treatment plant. Typically, when about ten feet or so of liquid is left in the tank, the nozzle system 10 is activated and mixing begins. This process allows entrainment of any settled and accumulated solids at the tank bottom so such sediment may be pumped out of the tank.

Figure 2:
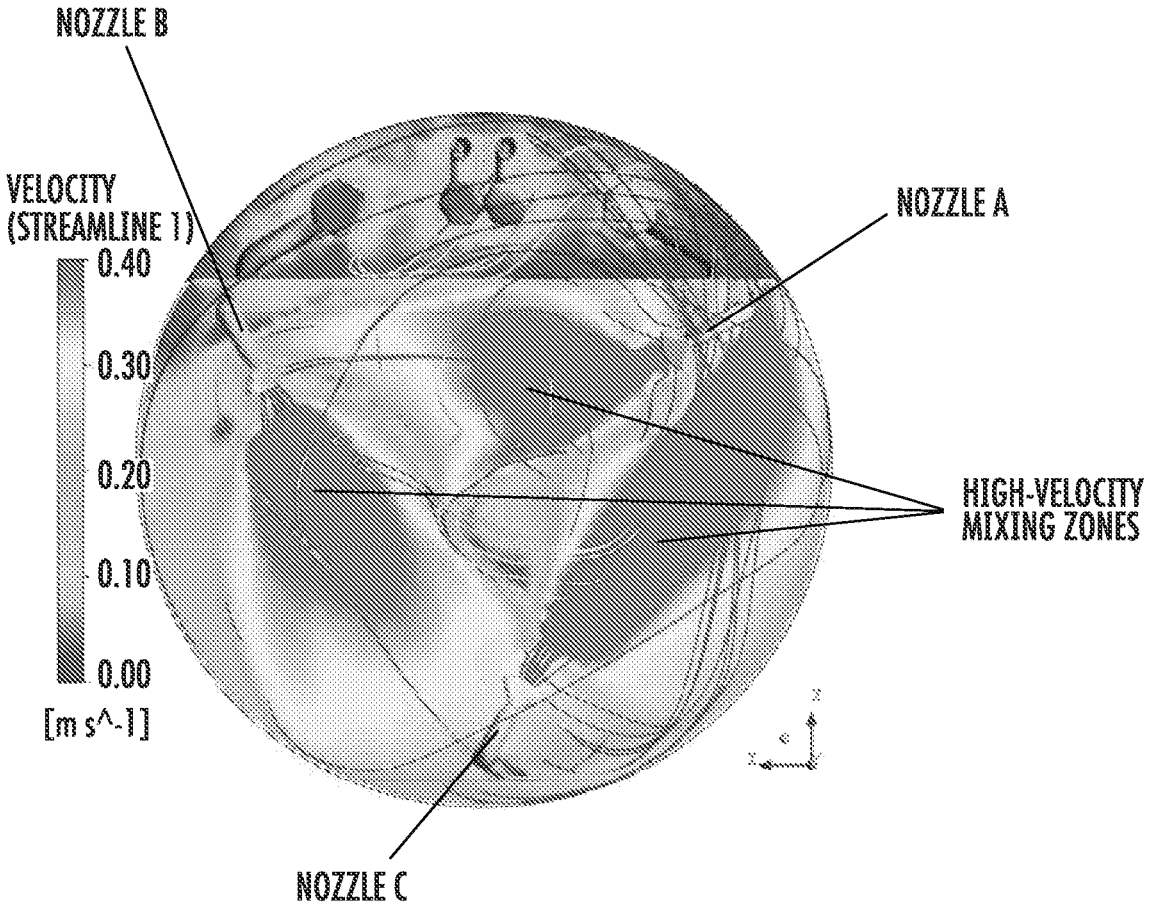
FIG. 2 is a CFD image of an embodiment of the present tank mixing system.
Figure 4:
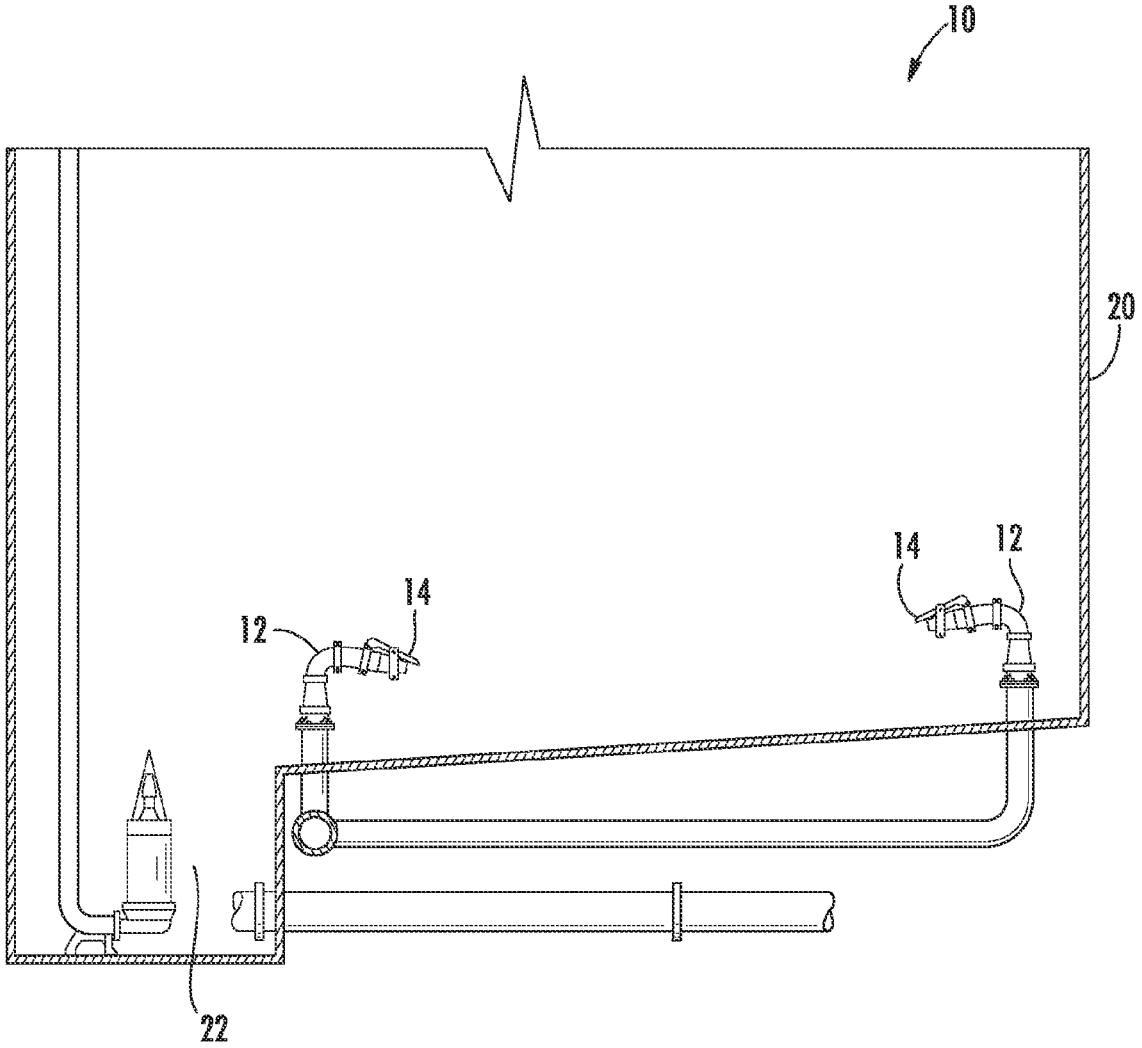
FIG. 4 is a side view of an embodiment of the present system.
Figure 5:
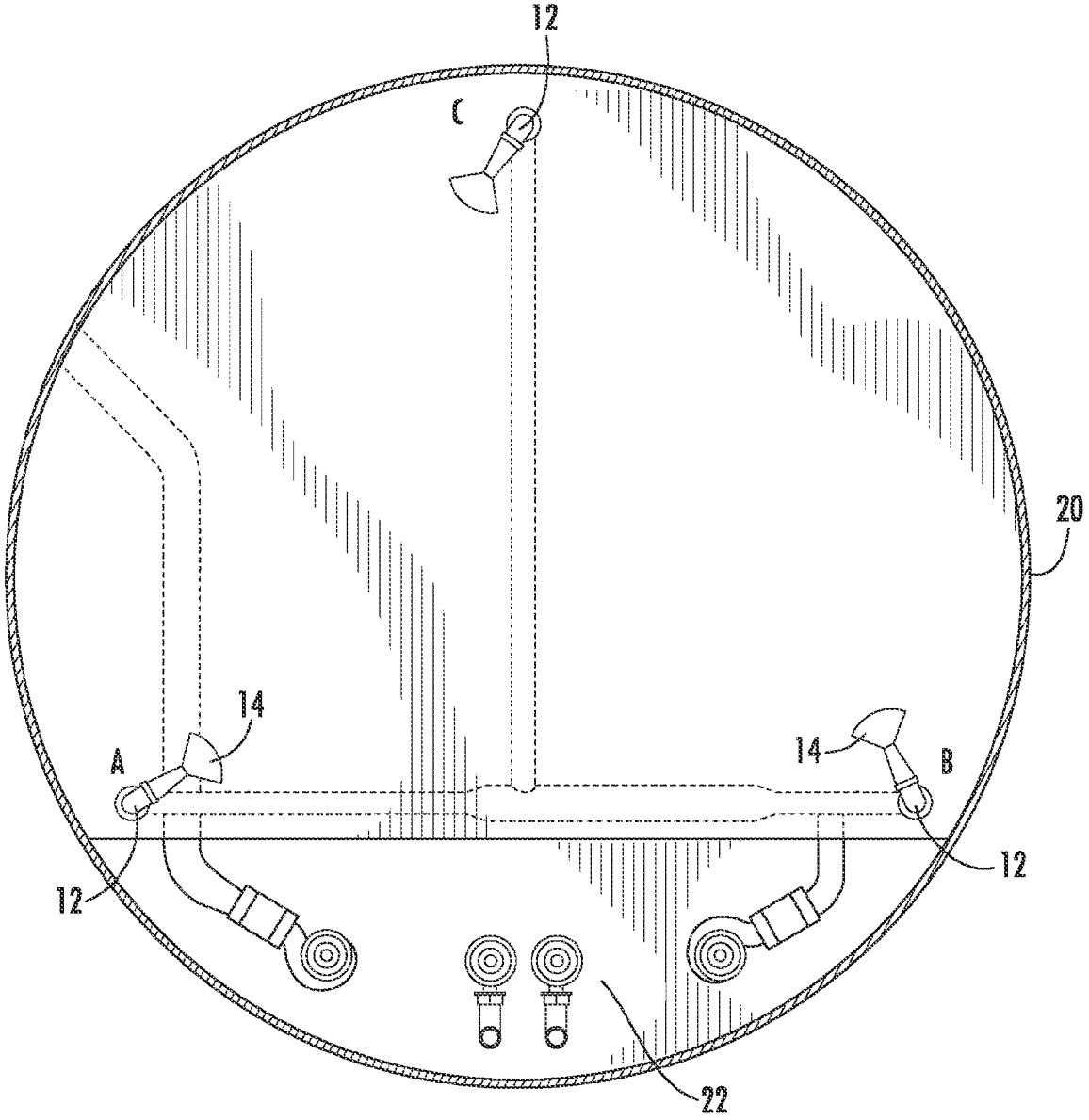
FIG. 5 is a top view of an embodiment of the present system.
Figure 6:
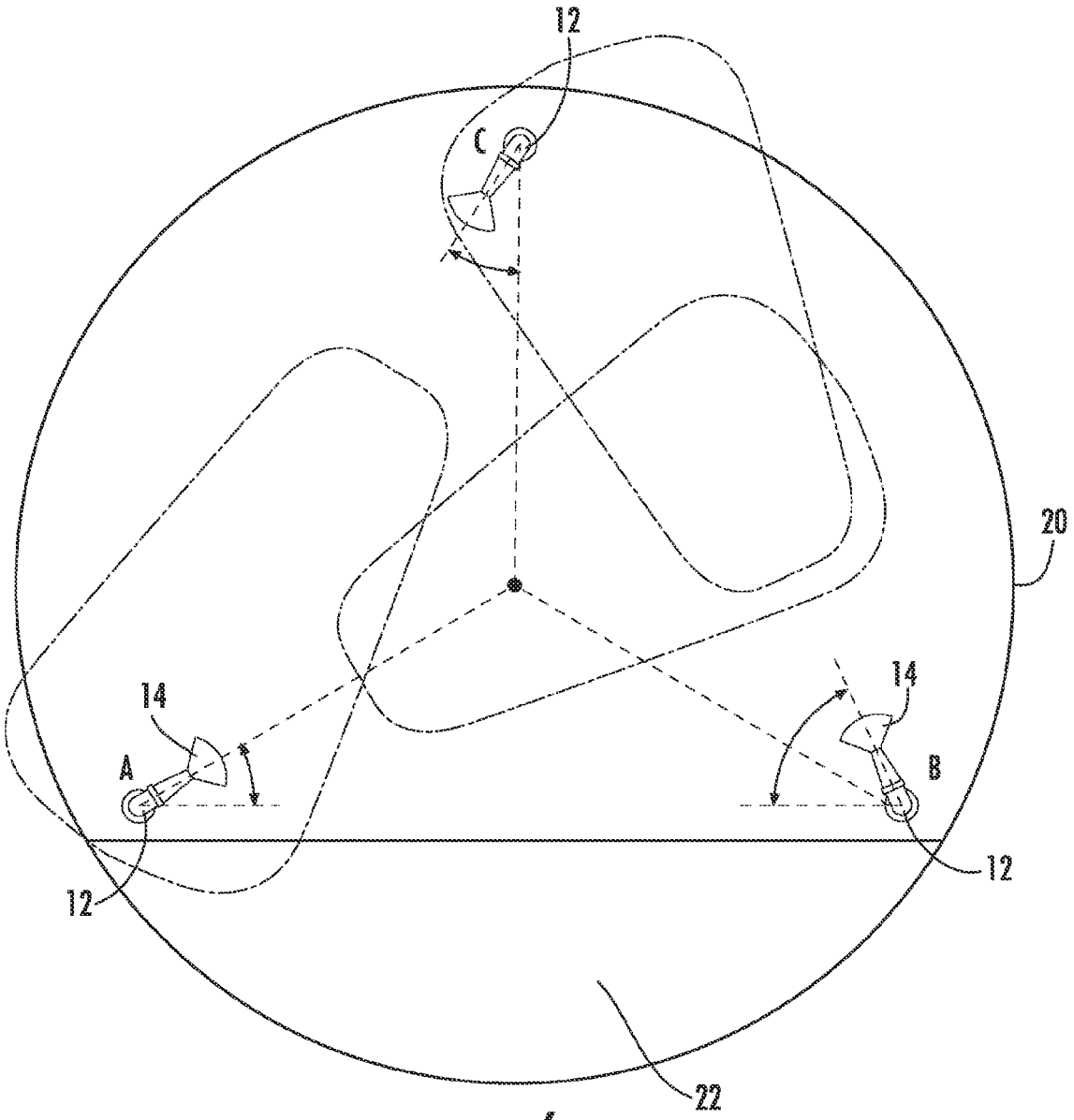
FIG. 6 is a top view of an embodiment of the present system illustrating representative spray patterns.

A CSO tank system is illustrated in FIGS. 1 and 2, as well as in FIGS. 4-6. In the demonstrated systems, three single nozzles (Rotamix® system by Vaughan Company of Montasano, Wash.) are positioned within a cylindrical tank at 120 degree intervals about the tank circumference and a distance inward of the tank wall. The three nozzles (A, B, and C) in each tank are floor-mounted via a feed pipe 24 which typically rises approximately one foot above the tank floor. In the system of FIG. 1 (the prior art), each nozzle is aimed to discharge a stream horizontally at anywhere from about 25 to about 45 degrees to the right of a radius intersecting the nozzle base. When submerged, a mostly tangential mixing flow is created from the three nozzles (see labeled dark flow lines of FIG. 1), leaving a low-velocity hole at the center of the tank (see labeled light zone of FIG. 1) which allows settling of solids to the tank bottom.

Figure 3:
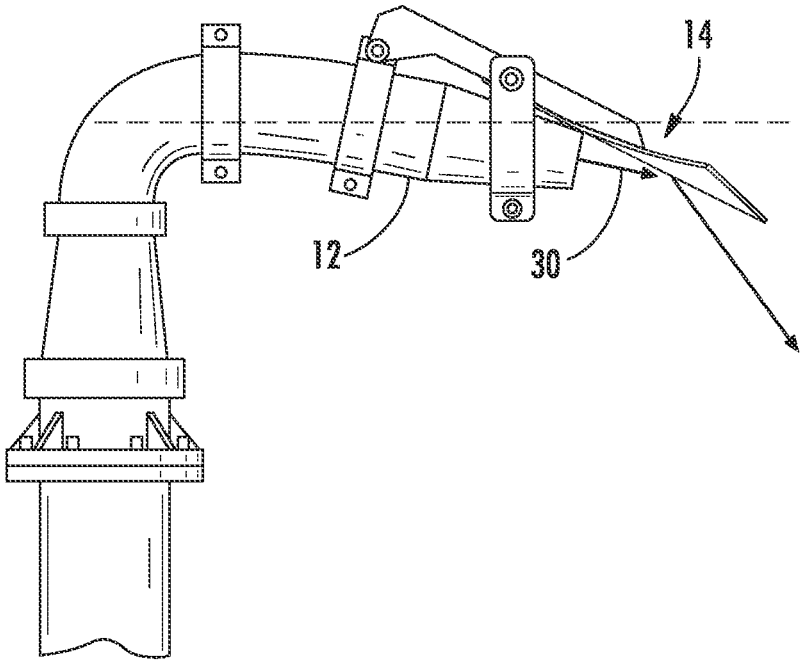
FIG. 3 is a perspective view of one embodiment of a liquid dispensing nozzle in accordance with the present invention.

Conversely, in the system of FIG. 2 (an embodiment of the present invention), a splash plate 14 is attached above each nozzle opening. As shown in FIG. 3, as a concentrated liquid stream 30 is discharged from the nozzle 12, the initial stream 30 is deflected downward by the splash plate 14 and dispersed outward in a direction perpendicular to the initial nozzle discharge. The "B" and "C" nozzles of the system 10 in FIGS. 2, 5 and 6 are aimed to discharge a stream slightly downward, preferably in a range of from about 5 to about 20 degrees below horizontal, most preferably about 11.5 degrees below horizontal, and off-center from about 25 to about 45 degrees to the right of a radius intersecting the nozzle base, preferably about 30 degrees to the right of the intersecting radius. In the illustrated embodiment, the "A" nozzle of the tank is similarly aimed downward, but instead of being off-center it is directed at the center point of the tank 20. As noted above, this configuration provides a good mixing velocity for the tank contents, while avoiding the creation of a large low-velocity zone in the tank center.

As the contents are drained from the tank 20, another advantage of the system 10 can be recognized. Even in the best of systems some debris and sediment will settle to the tank bottom. The present system 10 will effectively remove such debris and sediment to prepare the CSO tank 20 for the next time it is needed. That is, the downwardly directed spray from the splash plate covered nozzles 12 will wash any residual solids on the tank bottom into a sump 22 located at the low end of the sloped floor.

In other embodiments, it is understood that even a single nozzle 12 equipped with a splash plate 14, as shown in FIG. 3, could be employed to scour a surface to remove settled debris. For example, the influent channels 40 illustrated in FIGS. 7 and 8 feed liquid to a larger grit chamber 45 and may use nozzles 12 with attached splash plates 14 to create a spread stream which will move solid material into the grit chamber 45. These channels 40 are not typically used to hold water for any period of time like a CSO tank 20 (FIG. 2), but they can channel large volumes of fluid having entrained solids. The channel opening 42, an area just before the grit chamber 45 shown best in FIG. 8, is occasionally subject to development of a low-velocity pool where debris may collect and sediment may settle out. If the buildup is large enough, flow from the channel may become impeded.

Figure 7:
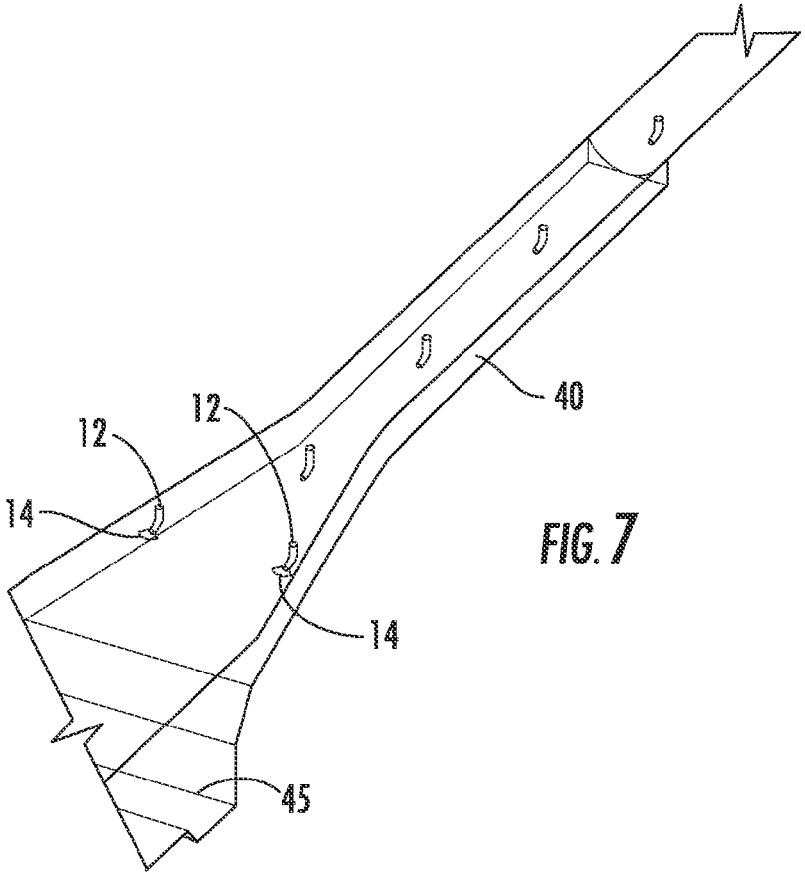
FIG. 7 is a partial perspective view of an embodiment of the nozzle system employed in a influent channel.
Figure 8:
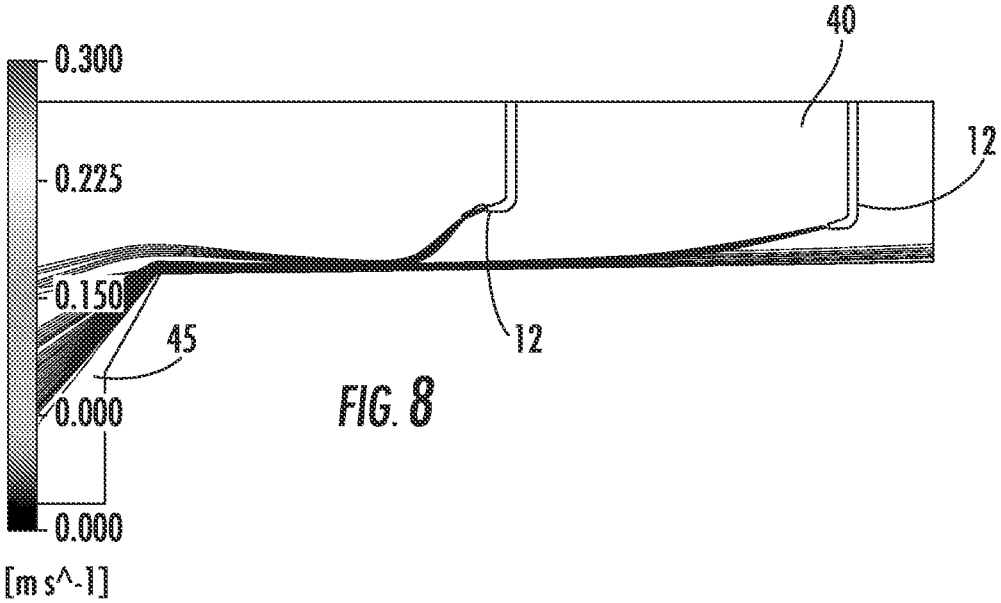
FIG. 8 is a side cross section of the channel opening of FIG. 7.

Placement of even a single splash plate-fitted nozzle 12 at this low-velocity area, or two such nozzles 12 as shown in FIG. 7, would serve to scour the channel bottom surface to help maintain fluid flow.

The present system 10 is not limited to use in channels and circular mixing or holding tanks. Further, the splash plate 14 equipped nozzle 12 of FIG. 3 is also not limited to tank bottom positioning, as it may also be used at or even above the liquid surface of a mixing tank. The downward directed spread of liquid has demonstrated effectiveness at driving floating debris into the mixing pattern of a system.

Figure 9:
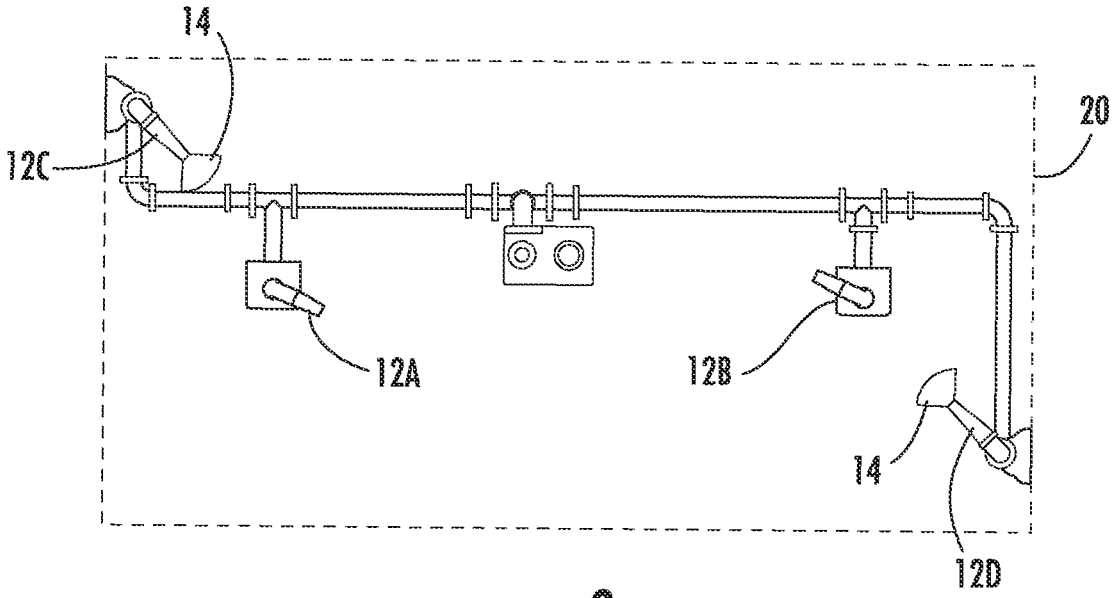
FIG. 9 is a top view of a mixing system employing an embodiment of the present nozzle system.
Figure 10:
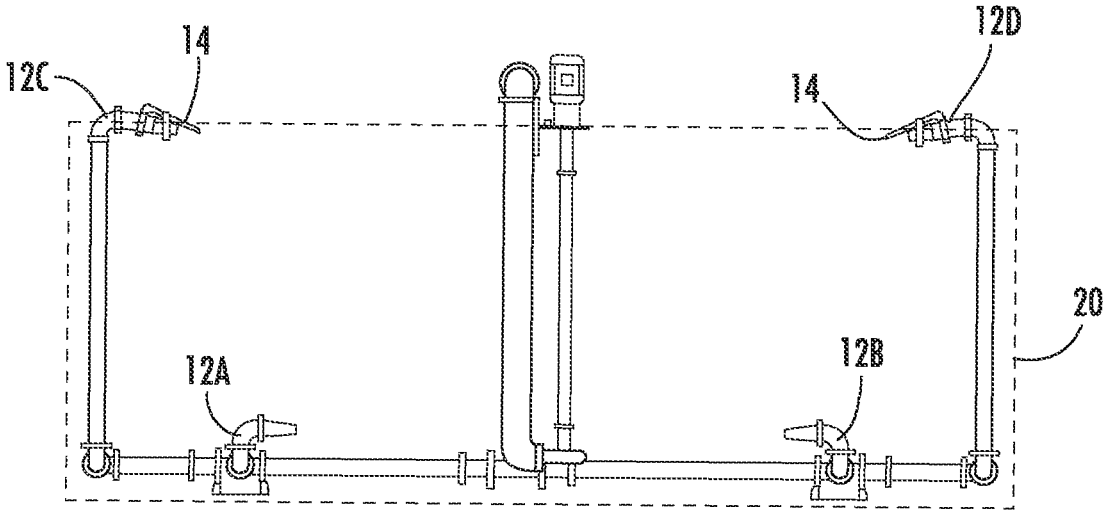
FIG. 10 is a side view of the mixing system shown in FIG. 9.

For example, tanks are employed in some plants for creating energy from a ground corn (i.e., corn stover) and animal manure slurry for downstream hydrolysis and digester tanks (not shown). One known system, illustrated in FIGS. 9 and 10, is comprised of a rectangular tank (approx. 33 ft.×16 ft.×13 ft.) having four Rotamix® nozzles 12A-D at two different levels. Two of the nozzles, 12A and 12B, are positioned at floor level and the other two nozzles, 12C and 12D, are positioned at the top of the tank 20. The floor-mounted nozzles, 12A and 12B, are preferably positioned on opposite sides at a longitudinal centerline and are aimed approximately +22.5 degrees off-center. Conversely, the two top-mounted nozzles, 12C and 12D, are located in corners opposite each other and opposite the aimed direction of the closest floor-mounted nozzle—i.e., to the negative angle side. The top-mounted nozzles 12C, 12D are preferably aimed downward at about 22.5 degrees and 45 degrees off the adjacent tank walls. Of course, the noted angle measures of the nozzles are approximate and specific to the illustrated embodiment, as is the number and positioning of the nozzles. Alterations will likely be necessary to customize a nozzle system for each system. Such alterations would certainly be possible by those skilled in the art after an explanation of the present system.

Still referring to FIGS. 9 and 10, each nozzle 12C and 12D includes a splash plate 14 so as to further direct a discharge downward in a spray at the tank contents. The mixing pattern for rectangular tanks is generally rotational—though not circular—about the tank's vertical axis with vertical (up/down) mixing as well due to the four corners. Any floating corn debris is driven downward into the mixing slurry by the spray from the upper nozzles 12C, 12D. The use of a splash plate 14 mounted above the opening on each of the top-mounted nozzles 12C, 12D allows a greater area of the tank content surface to be covered by the spray.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A system for moving solids accumulated on a surface, the system comprising:

a plurality of liquid dispensing nozzles positioned above a surface upon which solids accumulate over time, each of the nozzles having an inlet for receiving pressurized liquid and an outlet for ejecting a liquid stream along a path; and at least one splash plate attached to one of the plurality of liquid dispensing nozzles and positioned superiorly adjacent to the outlet of the at least one nozzle extending into the path of the liquid stream and at an angle of inclination relative to the path so as to deflect a stream from the nozzle outlet toward and spread over an area of the surface to thereby move or prevent accumulated solids;

a liquid source for supplying each nozzle with pressurized fluid; and a pump coupling the liquid source to the plurality of liquid dispensing nozzles.

2. The system of claim 1, wherein the angle of inclination is in the range of from about five degrees to about 30 degrees.

3. The system of claim 2, wherein the angle of inclination is in the range of from about 10 degrees to about 20 degrees.

4. The system of claim 3, wherein the angle of inclination is about 15 degrees.

5. The system of claim 1, wherein each of the plurality of liquid dispensing nozzles is inclined toward the surface at an angle in the range of from about five to about 20 degrees.

6. The system of claim 5, wherein each of the plurality of liquid dispensing nozzles is inclined toward the surface at an angle of about 11.5 degrees.

7. The system of claim 1, wherein the at least one splash plate is substantially flat.

8. The system of claim 1, wherein the at least one splash plate is curved.

9. A system for removing sediment deposited on a surface, the system comprising:

a supply of liquid;

a liquid dispensing nozzle positioned above a surface onto which sediment accumulates over time, the nozzle having an inlet for receiving pressurized liquid and an outlet for ejecting a liquid stream along a path;

a splash plate attached to the liquid dispensing nozzle and positioned superiorly adjacent to the nozzle outlet extending into the path of the liquid stream at an angle of inclination relative to the path such that a liquid stream from the nozzle outlet is deflected toward and spread over an area of the surface; and a pump fluidly coupling the nozzle inlet to the supply of liquid and operating to pump material from the supply through the nozzle outlet.

10. The system of claim 9, wherein the angle of inclination is in the range of from about 5 degrees to about 30 degrees.

11. The system of claim 10, wherein the angle of inclination is in the range of from about 10 degrees to about 20 degrees.

12. The system of claim 11, wherein the angle of inclination is about 15 degrees.

13. A wastewater storage tank system comprising:

a tank having a bottom surface where solid material within wastewater settles and accumulates and an enclosed volume fed by an inlet for delivering wastewater into the tank and an outlet for discharging wastewater there from;

a nozzle positioned within the tank, the nozzle having an inlet for receiving pressurized liquid and an outlet for ejecting a liquid stream along a path;

a splash plate attached to the nozzle and positioned superiorly adjacent to the nozzle outlet extending into the path of the liquid stream at an angle of inclination relative to the path such that a liquid stream from the nozzle outlet is deflected toward and spread over an area of the tank bottom; and a pump having an inlet fluidly connected to the tank and operates to pump material from the tank through the nozzle outlet.

14. The wastewater storage tank system of claim 13, wherein the angle of inclination of the splash plate relative to the path of the liquid stream is in the range of from about five degrees to about 30 degrees.

15. The wastewater storage tank system of claim 14, wherein the angle of inclination is in the range of from about 10 to about 20 degrees.

16. The wastewater storage tank system of claim 15, wherein the angle of inclination is about 15 degrees.

17. A mixing system for driving floating debris into a liquid medium, the system comprising:

a supply of liquid stored within a tank and having debris floating at or near the liquid surface;

a liquid dispensing nozzle positioned above the liquid surface, the nozzle having an inlet for receiving pressurized liquid and an outlet for ejecting a liquid stream along a path;

a splash plate attached to the liquid dispensing nozzle and positioned superiorly adjacent to the nozzle outlet to extend into the path of the liquid stream at an angle of inclination relative to the path so as to deflect the stream toward and spread the stream over an area of the liquid surface; and a pump fluidly coupling the nozzle inlet to the supply of liquid and operating to pump material from the supply through the nozzle outlet.

18. The mixing system of claim 17, wherein the angle of inclination is in the range of from about five degrees to about 30 degrees.

19. The system of claim 18, wherein the angle of inclination is in the range of from about 10 degrees to about 20 degrees.

20. The system of claim 19, wherein the angle of inclination is about 15 degrees.

21. The system of claim 17, wherein the liquid dispensing nozzle is inclined toward the liquid surface at an angle in the range of from about five to about 40 degrees.

22. The system of claim 21, wherein the liquid dispensing nozzle is inclined toward the liquid surface at an angle of about 22.5 degrees.

23. The system of claim 17, wherein the splash plate is substantially flat.

24. The system of claim 17, wherein the splash plate is curved.

* * * * *